US005501547A

United States Patent [19]

Mantelli

[11] Patent Number: 5,501,547

[45] Date of Patent: Mar. 26, 1996

[54] MODULAR CHANNEL SECTION ASSEMBLY FOR PROVIDING A DRAINAGE SYSTEM

[75] Inventor: Giulio Mantelli, Altare, Italy

[73] Assignee: First Plast S.R.L., Altare, Italy

[21] Appl. No.: 272,869

[22] Filed: Jul. 8, 1994

Related U.S. Application Data

[63] Continuation of Ser. No. 974,281, Nov. 10, 1992, abandoned.

[30] Foreign Application Priority Data

Nov. 11, 1991 [IT] Italy ..... RM91U0216

[51] Int. Cl.[6] ..... E03F 1/00

[52] U.S. Cl. ..... 405/121; 405/119; 405/118; 404/3; 52/11; 52/98; 52/726.1; 52/169.5

[58] Field of Search ..... 404/2–4; 52/169.5, 52/11, 726.1, 737, 98; 405/118, 119, 121, 124

[56] References Cited

U.S. PATENT DOCUMENTS

| | | | |
|---|---|---|---|
| Re. 33,439 | 11/1990 | Thomann et al. | 52/169.5 X |
| 643,677 | 2/1900 | Payne | 404/2 |
| 2,701,535 | 2/1955 | Sholl | 405/121 |
| 3,225,545 | 12/1965 | Fiegel | 404/2 X |
| 4,490,067 | 12/1984 | Dahowski | 404/4 |

FOREIGN PATENT DOCUMENTS

| | | | |
|---|---|---|---|
| 2652839 | 4/1991 | France . | |
| 3519108 | 12/1986 | Germany . | |
| 0803101 | 10/1958 | United Kingdom | 404/2 |

*Primary Examiner*—Robert J. Canfield
*Attorney, Agent, or Firm*—Stevens, Davis, Miller & Mosher

[57] ABSTRACT

A modular assembly of channel sections (2) is disclosed which are connected to one another for providing a drainage system by a shutter coupling between a groove 24 formed at one end of any channel section and a rib (6') formed at the other end. Channel section (2) has a modular construction as it is provided with a number of parallel ribs (6') extending in a plane perpendicular to the length of the section at regular intervals so that the length of the final assembled channel can be changed by varying the coupling of the sections. Further anchoring ribs (6) are provided near ribs (6'). A shutter head member (26) coupled at either end of channel section (2) and having a dead but easily pierceable pipe fitting (30) is also provided.

21 Claims, 2 Drawing Sheets

MODULAR CHANNEL SECTION ASSEMBLY FOR PROVIDING A DRAINAGE SYSTEM

This application is a CONTINUATION of application Ser. No. 07/974,281, filed Nov. 10, 1992, now abandoned.

The present invention relates to a drainage system assembly for water or other liquids.

Drainage system assemblies, for example, for rain water or any other liquid are used in several both covered and uncovered places.

The known drainage assemblies, however suffer from the drawback that they cannot be easily fitted to the requested length.

One object of the present invention is to avoid that drawback.

Another object of the present invention is to provide a gutter assembly having anchoring means for its securing to the cement support on which it is laid.

Still a further object of the present invention is to provide a drainage assembly which can be easily and quickly assembled without requiring special means.

Such objects are achieved by providing channel sections whose basic feature consists in being modular and connectable to one another to form a modular construction, thus allowing the length thereof to be shortened by cutting them at a predetermined distance and keeping the connection capability of any section to the other sections unchanged, which widens the range of possible lengths of the final assembled channel.

Therefore, the present invention relates to a drainage channel for water or any other liquid comprising channel sections of semitubular form having pairs of first and second ribs extending in a plane perpendicular to the channel section at the outer surface of the same in a short distance from each other, which pairs are provided along the length of the channel section at regular intervals which are submultiple of the length of the channel section, the first ribs being shaped so as to facilitate the engagement of the channel section to the cement support on which it is laid, the second ribs being formed with a male profile so as to provide a shutter coupling with a corresponding groove provided at one end of the channel section. The second rib of each pair of ribs is nearer to such groove so that the channel sections always end in a male profile, when they are cut at the gap between the two ribs to reduce their length, and can always be coupled in their full or reduced length to form channels of given length.

The invention also provides a shutter head member which can be coupled at both ends of the channel section as it is provided with a profile for shutter engagement into the above-mentioned groove at one end, and with a projecting edge adapted to engage the other end of the channel section and to fit the inner shape thereof.

According to a further feature of the invention, such head member is also provided with a dead but easily pierceable pipe fitting.

Preferred embodiments are set forth in the depending claims.

Figure 1:
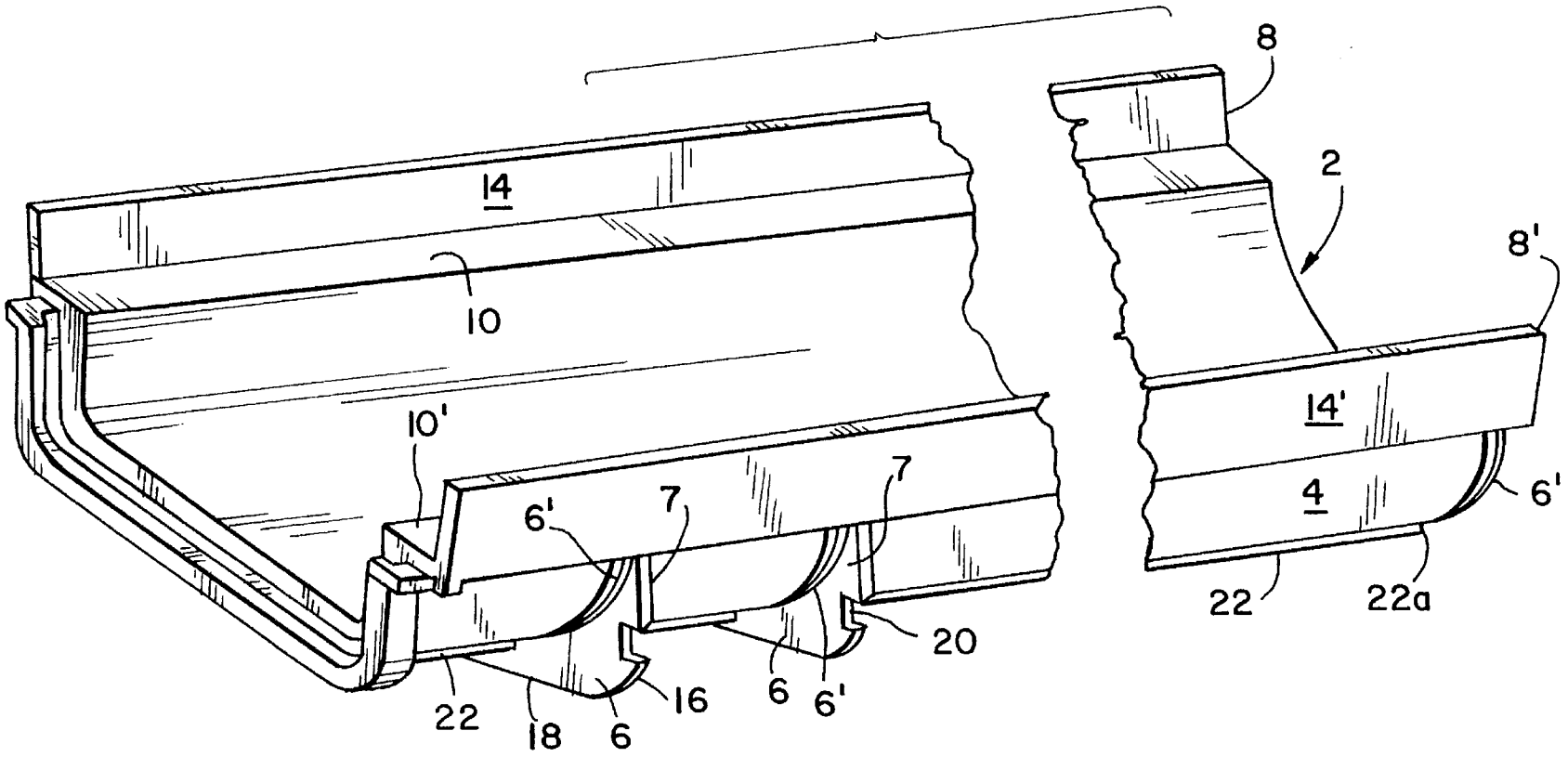
Figure 2:
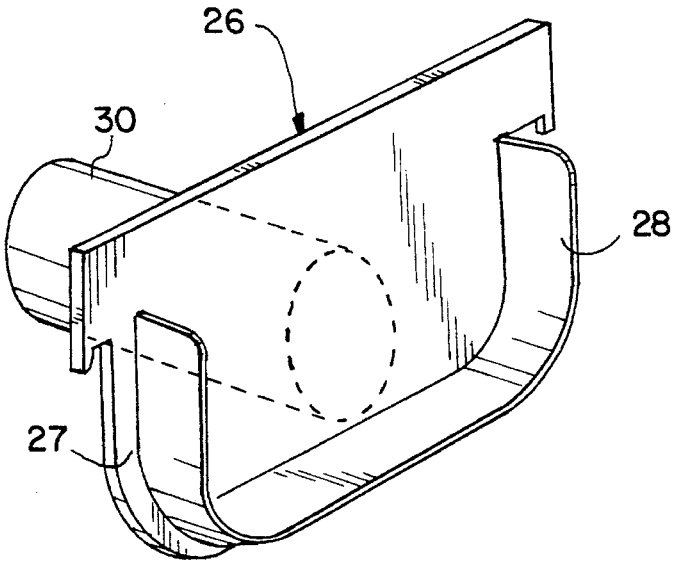

The present invention will be best understood referring to the following detailed description of a preferred embodiment illustrated only by way of a non-limitative example in the accompanying drawings, in which:

FIG. 1 is a perspective side view of the channel section according to the present invention;

FIG. 2 still shows a perspective view of the shutter head member.

Figure 3:
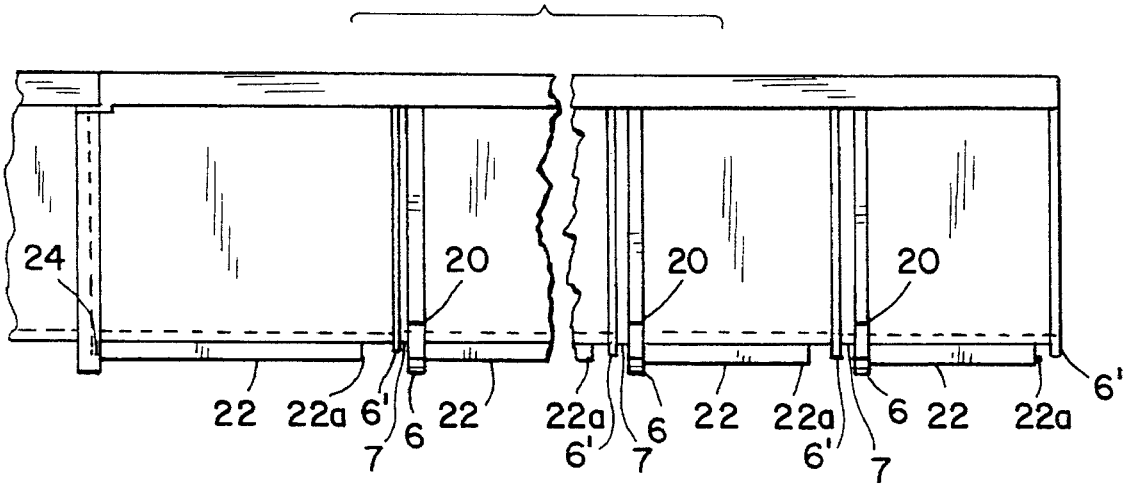

FIG. 3 is a side elevational view of an assembly of sections of FIG. 1.

With reference to the figures the channel section includes two pieces 2 and 26 both of plastic material. Channel section 2 has a generally semitubular form with an outer surface 4 having several pairs of first and second ribs 6, 6' laying in planes perpendicular to the extension of the channel at regular intervals which are submultiple of the length of channel section 2. The rims of the channel section 2 are provided with enbankment edges having a L-shaped section. Ribs 6, 6' end against the horizontal legs 10, 10' of such enbankment edges at a distance from the vertical legs 14, 14' thereof. Ribs 6 perform the function of anchoring the channel section to the cement support on which they are laid. To this purpose they have a generally rectangular shape with chamfers 16 provided at the corners of the bottom sides 18 and notches 20 provided at the lateral sides after the chamfers. Stiffening rods 22 extend longitudinally at the bottom of the channel section and form a further anchoring member both crosswise and lengthwise by means of free end 22*a*. Ribs 6' have the shape of the channel section and a lower height than ribs 6 as they project a little from the surface of channel section 2 and create a space between 6' and 6. They have a function described afterwards and contribute to the lengthwise anchorage of the channel section.

Channel section 2 has a double modularity as it is intended to form a channel by being connected to other channel sections, besides its construction is such as to provide a piece similar to but shorter than the original when it is cut in predetermined lengths. The modularity of channel section 2 widens the range of possible lengths of the channel as the multiples of the channel section lengths add to the multiples of the lengths of the cut modular pieces. Such modular construction of the cut pieces is due to the fact that the above-mentioned ribs 6' are provided at regular intervals along the extension of channel section 2, and that a groove 24 for shutter engagement, which can be coupled to ribs 6', is provided at one end of channel section 2.

The length of channel section 2 is reduced by being cut between ribs 6' and 6 in space 7 so as to always end in a rib 6'. Of course the cutting operation should keep groove 24 for shutter engagement so that the channel section is always shortened by cutting away its opposite end. The cutting operation is carried out by an ordinary bow saw.

Advantageously the room between ribs 6 and 6' is such as to allow the bow saw to be inserted therebetween, thus acting as a guide. A guide notch for the bow saw can be also provided in such room to make the sawing operation easier.

According to a particularly preferred embodiment of the present invention, the length of channel section 2 is 50 cm and the distance between ribs 6 of two adjacent rib 6 or the distance between ribs 6' of two adjacent ribs 6' is 10 cm. Thus lengths of the channels multiple of 10 cm are possible. The tongue and groove connection between rib 6' and groove 24 of an adjacent section is made stronger by adhesives such as for example glues or silicones.

The channel section of the present invention comprises also a shutter head member 26 adapted to be coupled to groove 24. It has on one side a horizontally projecting edge 28 which can engage channel section 2 so as to fit the inner shape thereof, and on the other side a pipe fitting 30. Due to edge 28 head member 26 can also be coupled at the opposite end of the channel section, i.e. that end without groove, such coupling being made stronger by adhesives such as silicone glue. An adhesive will make stronger also the shutter connection between channel sections 2 as mentioned above. Head member 26 is a dead piece, i.e. pipe fitting 30 has originally a dead end, but it can be pierced by an easy operation. With this construction head member 26 can either connect or shut off a water leak to one end of the channel section. Of course the gutter assembly 2, 26 of the present invention can be dimensioned at will. By changing the depth and/or the width of channel section 2 it is possible to vary the water flow rate and by changing the size of pipe fitting 30 several pipes of different diameters can be connected.

The present invention has been described with reference to a preferred embodiment thereof but it is obvious that changes and/or additions can be made without departing from its scope as defined in the appended claims.

I claim:

1. A modular channel section assembly for a drainage system for water or other liquids, comprising a plurality of channel sections (2) having ends connected to each other, each said channel section having a plurality of pairs of ribs, each pair having a first rib (6) and a second rib (6'), both ribs of each pair extending in planes perpendicular to the channel section at an outer surface (4) of said channel section, each said channel section defining an internal groove (24) on one end thereof and a second rib 6' on the other end, pairs of first and second ribs being provided along the length of each channel section at regularly spaced intervals which are submultiples of the length of each channel section (2), said first rib (6) of each pair being shaped so as to facilitate engagement of said channel sections to a cement support on which said channel section is adapted to be laid, said second rib (6') of each pair being spaced from said first rib (6) and being formed with a male profile, an end second rib (6') of a first channel section coupled with a groove (24) provided at one end of an adjacent second channel section (2), said second rib (6') of each pair on each channel section being nearer to said groove (24) on one end thereof than said first rib (6) so that when a channel section is cut between first and second ribs of a rib pair at a second rib (6') to reduce the length of said channel section, said section of reduced length has a groove (24) adapted to couple with an end second rib (6') of an adjacent channel section to form a channel extension of a length multiple of the distance between said groove (24) and said second rib (6') of said reduced length channel section.

2. The modular channel section assembly according to claim 1, comprising a shutter head member (26) provided with a male profile (27) for shutter engagement with a groove (24), and on one side with a projecting edge (28) adapted to fit within an inner surface (5) of a channel section (2) and on the other side with a pipe fitting (30) which has a closed end but easily piercable, so that said head member (26) can be used at a grooved end of a channel section or fixed to another end of a channel section formed with a male profile.

3. The modular channel section assembly according to claim 2, wherein couplings between said end second rib (6') and said groove (24); said male profile (27) and said groove (24); and said inner surface (5) and said projecting edge (28) are made stronger by means of silicone glue or adhesives.

4. The modular channel section assembly according to claim 1, wherein each said channel section has edges provided with L-shaped embankment profiles (8, 8').

5. The modular channel section assembly according to claim 4, wherein a channel section has a bottom and stiffening rods (22) engaging first ribs (6) and extending longitudinally along the bottom of the channel section for its anchoring.

6. The modular channel section assembly according to claim 1, wherein each channel section (2) is 50 cm long and said space between ribs (6 and 6) or (6' and 6') of adjacent pairs is 10 cm.

7. The modular channel section assembly according to claim 1, including a head member (26) and wherein both said channel sections (2) and said head member (26) are of plastic material.

8. The modular channel section assembly according to claim 2, wherein couplings between said end second rib (6') and said groove (24); said male profile (27) and said groove (24); and said inner surface (5) and said projecting edge (28) are fixed together by means of silicone glue or adhesives.

9. The modular channel section assembly according to claim 2, wherein said first ribs (6) project so as to form a rectangular profile with chamfered corners.

10. The modular channel section assembly according to claim 9, wherein each said channel section has edges with L-shaped embankment profiles (8, 8').

11. The modular channel section assembly according to claim 10, wherein a channel section has a bottom and stiffening rods (22) engaging first ribs (6) and extending longitudinally along the bottom of the channel section for its anchoring.

12. The modular channel section assembly according to claim 9, wherein a channel section has a bottom and stiffening rods (22) engaging first ribs (6) and extending longitudinally along the bottom of the channel section for its anchoring.

13. The modular channel section assembly according to claim 2, wherein each said channel section has edges provided with L-shaped embankment profiles (8, 8').

14. The modular channel section assembly according to claim 13, wherein a channel section has a bottom and stiffening rods (22) engaging first ribs (6) and extending longitudinally along the bottom of the channel section for its anchoring.

15. The modular channel section assembly according to claim 2, wherein a channel section has a bottom and stiffening rods (22) engaging first ribs (6) and extending longitudinally along the bottom of the channel section for its anchoring.

16. The modular channel section assembly according to claim 2, wherein each channel section (2) is 50 cm long and said space between ribs (6 and 6) or (6' and 6') of adjacent pairs is 10 cm.

17. The modular channel section assembly according to claim 1, wherein each said channel section has a bottom and stiffening rods (22) engaging first ribs (6) and extending longitudinally along the bottom of the channel section for its anchoring.

18. The modular channel section assembly according to claim 1, wherein said first ribs (6) project so as to form a rectangular profile with chamfered corners.

19. The modular channel section assembly according to claim 18, wherein each said channel section has edges with L-shaped embankment profiles (8, 8').

20. The modular channel section assembly according to claim 19, wherein a channel section has a bottom and stiffening rods (22) engaging first ribs (6) and extending longitudinally along the bottom of the channel section for its anchoring.

21. The modular channel section assembly according to claim 18, wherein a channel section has a bottom and stiffening rods (22) engaging first ribs (6) and extending longitudinally along the bottom of the channel section for its anchoring.

* * * * *